US010737831B2

(12) United States Patent
Adjian et al.

(10) Patent No.: US 10,737,831 B2
(45) Date of Patent: Aug. 11, 2020

(54) METHOD AND APPARATUS FOR SEALING AN OPENED BEVERAGE CONTAINER

(71) Applicants: Gevorg Adjian, North Hollywood, CA (US); Aaron Michael Johnson, Los Angeles, CA (US); Devin Charles Kirtz, Los Angeles, CA (US)

(72) Inventors: Gevorg Adjian, North Hollywood, CA (US); Aaron Michael Johnson, Los Angeles, CA (US); Devin Charles Kirtz, Los Angeles, CA (US)

( * ) Notice: Subject to any disclaimer, the term of this patent is extended or adjusted under 35 U.S.C. 154(b) by 372 days.

(21) Appl. No.: 15/616,766

(22) Filed: Jun. 7, 2017

(65) Prior Publication Data

US 2018/0354679 A1 Dec. 13, 2018

(51) Int. Cl.
*B65D 17/00* (2006.01)
*B65D 17/28* (2006.01)

(52) U.S. Cl.
CPC .. *B65D 17/4014* (2018.01); *B65D 2517/0044* (2013.01)

(58) Field of Classification Search
CPC ..... B65D 17/4014; B65D 2517/0044; B65D 2517/0029; B65D 17/166; B65D 2517/0014; B65D 2517/0035; B65D 51/28; B65D 51/18; B65D 51/20
See application file for complete search history.

(56) References Cited

U.S. PATENT DOCUMENTS 5,351,853 A * 10/1994 Shock ..... B65D 51/007 220/258.2
5,743,445 A * 4/1998 Benarrouch ..... B65D 17/4012 222/541.9
2005/0284263 A1* 12/2005 Klosterman ..... B67B 7/403 81/3.55
2007/0051725 A1* 3/2007 Glade ..... B65D 51/007 220/254.4
2007/0131690 A1* 6/2007 Gavino Nadal ... B65D 17/4014 220/254.4
2008/0245191 A1* 10/2008 Bailly ..... B67B 7/403 81/3.15

(Continued)

*Primary Examiner* — Andrew M Tecco
*Assistant Examiner* — Nicholas E Igbokwe
(74) *Attorney, Agent, or Firm* — Omid E. Khalifeh; Ariana K. Santoro; Omni Legal Group

(57) ABSTRACT

A method and apparatus for sealing an opened beverage container is characterized by a removable cover member with an upper, a middle, and a lower portion, the middle portion having a cavity configured to receive a beverage container's tab. When in use, in some embodiments, the present invention may provide that a user may insert a beverage tab into the cavity to removably form a tab/cover member combination. The user may then rotate the tab/cover member combination into position over a beverage container's opening. The user may then press down on the tab/cover member combination and insert the tab/cover member combination into the beverage container's opening, thereby removably sealing the beverage container's opening. If desired, the user may press on a raised edge attached to the present invention's upper portion and dislodge the tab/cover member combination from the beverage container's opening, thereby unsealing the beverage container's opening.

1 Claim, 7 Drawing Sheets

(56) References Cited

U.S. PATENT DOCUMENTS

| | | | | |
|---|---|---|---|---|
| 2011/0006064 | A1* | 1/2011 | Phillips | B67B 7/403<br>220/269 |
| 2016/0000246 | A1* | 1/2016 | Vanderstraeten | B65D 17/4014<br>220/270 |
| 2016/0059988 | A1* | 3/2016 | Kaziev | B65D 17/4014<br>220/269 |

* cited by examiner

METHOD AND APPARATUS FOR SEALING AN OPENED BEVERAGE CONTAINER

GOVERNMENT CONTRACT

Not applicable.

CROSS-REFERENCE TO RELATED APPLICATIONS

Not applicable.

STATEMENT RE. FEDERALLY SPONSORED RESEARCH/DEVELOPMENT

Not applicable.

COPYRIGHT & TRADEMARK NOTICES

A portion of the disclosure of this patent document may contain material which is subject to copyright protection. This patent document may show and/or describe matter which is or may become trade dress of the owner. The copyright and trade dress owner has no objection to the facsimile reproduction by any one of the patent document or the patent disclosure, as it appears in the Patent and Trademark Office patent files or records, but otherwise reserves all copyrights and trade dress rights whatsoever.

TECHNICAL FIELD

The disclosed subject matter relates generally to beverage closure devices and, more particularly, to a method and apparatus that may be used to seal an opened beverage container.

BACKGROUND

Many consumers enjoy carbonated beverages. In particular, carbonated beverages contained in so-called pop-top cans ("beverage containers") such as soda or beer are particularly popular. Typically, such beverage containers are shaped as cylinders that have a sealed opening on the beverage container's top. Using a tab on the top of the beverage container, the consumer may pull back on one end of the tab, creating a lever effect that pushes the other end of the tab into the beverage container's top, causing the tab's other end to puncture a pre-scored seal around the opening. Generally, the portion of the beverage container's top that was within the pre-scored portion bends into the beverage container's interior, which exposes the opening and thereby creates a rim around the opening, the rim being the portion of the beverage container's top surrounding the opening. With the opening thus exposed, the consumer can drink the beverage out of the beverage container's opening.

However, such beverage containers fail to provide for a way to reseal the opening. As such, in a matter of seconds or minutes the carbonation in the beverage is lost to the atmosphere and the beverage loses some or all of its appeal. In some circumstances, the beverage's carbonation may reach an equilibrium with the surrounding atmosphere and the pleasant effects of the carbonation may be effectively lost. In such circumstances, a user may determine that the beverage tastes dissatisfactory because of inadequate carbonation. In modern parlance, some users refer to a carbonated beverage that has lost its beneficial level of carbonation as "flat."

Additional problems are associated with non-carbonated items in beverage containers. Without a way to reseal the beverage containers, items such as fruit juice, applesauce, or smoothies could be spoiled by outside elements such as debris, insects, or air.

Therefore, a need exists to reseal beverage containers and preserve the beverage containers' contents.

Attempts at such a solution have been made. In particular, the disclosure of U.S. Pat. No. 6,321,927 to Cavella, incorporated by reference in its entirety herein, discloses a beverage container with a resealable opening in its top. While this disclosure does provide consumers with a resealable beverage container option, its design requires manufacturing entirely new beverage containers, which might be costly to the beverage industry. This disclosure also suffers from a relatively complex resealing design.

Another attempt can be seen with respect to U.S. Pat. No. 6,722,518 to Bartz, which is incorporated by reference in its entirety herein. This disclosure generally provides for a beverage container tab cover that may be rotated to reseal a beverage container's opening. Unfortunately, this disclosure's cover is configured to attach to a small area on the back of the beverage container's tab. Such a design makes this disclosure less likely to provide consumers with a consistent and easily used resealable option, as installing the cover and using the tab/cover combination might be cumbersome and the cover might be prone to falling off of the tab.

Still another attempt to solve the problem can be seen with respect to U.S. Patent Application Publication No. 2007/0138178 A1 filed by Erickson, which is incorporated in its entirety herein. This disclosure also generally provides for a beverage container tab cover that may be rotated to reseal a beverage container's opening. Unfortunately, however, this disclosure's design provides for a non-removable cover that may be attached to a rivet on a beverage container's top. Such a design not only limits the user's ability to reuse the cover, it might also require a high degree of dexterity to properly install the cover.

As such, none of these in existence comprise beneficial characteristics described in the following disclosure. Thus, there remains a need for a method and apparatus for sealing an opened beverage container.

SUMMARY

The present disclosure is directed to a method and apparatus for sealing an opened beverage container that provides users with the ability to quickly and easily reseal a beverage container and preserve the beverage's carbonation. For purposes of this disclosure, purely by way of illustration and not limitation, a beverage container may be considered to have an opening, and the beverage container's opening may have a rim defining the opening.

For purposes of summarizing, certain aspects, advantages, and novel features have been described. It is to be understood that not all such advantages may be achieved in accordance with any one particular embodiment. Thus, the disclosed subject matter may be embodied or carried out in a manner that achieves or optimizes one advantage or group of advantages without achieving all advantages as may be taught or suggested.

The present invention comprises a method and apparatus for sealing an opened beverage container. In some embodiments, the apparatus may be shaped like an elliptical disc having an upper, a middle, and a lower portion, as well as a front side, a top side, a back side, and a bottom side. It is contemplated that in certain embodiments, the present invention may provide for a cavity in the middle portion that opens to the front side, wherein the cavity is configured to receive a top end of a beverage container tab. The present invention may also provide for a notch in the front side of the present invention's lower portion that is configured to align with a beverage container's rivet. Furthermore, the present invention may provide for a raised edge on the top side of the present invention's upper portion.

To use the present invention, it is contemplated that a user may first insert align the present invention's cavity with the top of a beverage container's tab and align the present invention's notch with a beverage container's rivet. Then, a user may rotate the tab and the present invention so as to align the present invention over a beverage container's opening. The user may then push down on the present invention, causing the present invention to lodge within the opening, thereby removably sealing the opening. When the user wishes to unseal the opening, the user may press on the raised edge so as to dislodge the present invention from the opening. The user may then rotate the tab and the present invention back to its original starting position, or any other position the user may choose.

In some embodiments, the present invention's upper portion may be approximately disc-shaped, the middle portion may be shaped or configured to mimic or otherwise align with a beverage container's opening, and the lower portion may be approximately disc-shaped.

In some embodiments, the present invention's upper portion may provide for a tapered edge that extends the length of the upper portion's perimeter. In some embodiments, the tapered edge may extend for part of the length of the upper portion's perimeter. In still other embodiments, the upper portion's perimeter edge may not be tapered, but may for example be orthogonally oriented relative to the plane of the upper portion. In some embodiments, the tapered edge may slope towards the present invention's midline. In other embodiments, the tapered edge may slow away from the present invention's midline.

In some embodiments, the present invention's upper portion may extend further laterally than the present invention's lower portion. In other embodiments, the lower portion may extend further laterally than the upper portion. In still other embodiments, the upper portion and the lower portion may extend laterally in equal proportions.

In some embodiments, the present invention's middle portion may be cylindrical, oval, teardrop shaped, or any other shape, and may be of varying diameters and heights. In some embodiments, the middle portion may be configured so as to seal or otherwise align with a beverage container opening's rim. In some embodiments, the present invention's diameter may be of such size that the edges of the upper portion and the lower portion extend further laterally than the edge of the middle portion. In other embodiments, the middle portion may be of an approximately equivalent height or diameter as the upper portion, the lower portion, both the upper portion and the lower portion, or neither the upper portion nor the lower portion.

In some embodiments, the present invention's lower portion may provide for a tapered edge that extends the length of the lower portion's perimeter. In some embodiments, the tapered edge may extend for part of the length of the lower portion's perimeter. In still other embodiments, the lower portion's perimeter edge may not be tapered, but may for example be orthogonally oriented relative to the plane of the lower portion. In some embodiments, the tapered edge may slope towards the present invention's midline. In other embodiments, the tapered edge may slow away from the present invention's midline.

In some embodiments the lower portion's lower side may be convex. In other embodiments, the lower portion's lower side may be concave, flat, or any other shape compatible with the present invention.

In some embodiments, the present invention may provide for a defined border between the upper and middle portions, as well as the middle and lower portions. In some embodiments, the border between the middle and the lower portion may comprise a tapered edge groove, wherein the tapered edge groove approximates two tapered edges fixedly connected wherein the tapered edges slope toward the midline of the groove, having the longer sides positioned at the tapered edge groove's outer sides. It is contemplated that in some embodiments, the tapered edge groove may be configured to receive an edge, such as by way of illustration and not limitation, a beverage container opening's rim.

In some embodiments, the present invention may comprise one contiguous portion. In other embodiments, the present invention may be comprised of two portions. In other embodiments, the present invention may be comprised of four or more portions. It is contemplated that in the one, two, four or more portion embodiments, the present invention may provide for one or more of the elements generally disclosed herein pertaining to a three-portion embodiment, including by way of illustration and not limitation, the elements of a cavity configured to receive a beverage container tab, a raised edge, and a portion configured to seal or otherwise align with a beverage container opening's rim.

In some embodiments, a cavity within the middle portion may run parallel to the upper and lower portions, and may resemble an arch shape, or a rectangle with a half-moon for one of its short sides, the half-moon side being furthest from an opening. More specifically, in certain embodiments the side of the cavity opposite to the opening may be arcuate, and the other sides of the cavity may be straight. In other embodiments, the side of the cavity opposite to the opening may be straight, irregular, or any other shape capable of integration within the present invention. In some embodiments, the other sides of the cavity may be curved, irregular, or any other shape capable of integration within the present invention.

In some embodiments, the cavity may contain a raised portion. In some embodiments, the raised portion may be conical and extend upward from the lower side of the cavity. In other embodiments, the raised portion may be conical and extend downward from the upper side of the cavity. In some embodiments, the raised portion may be shaped as a raised disc, a raised square, a raised oval, or any other shape capable of integration within the present invention. In some embodiments, the point of origin of the raised portion may be in the center of the cavity's upper or lower side, or may be closer to or further away from the opening, and may also be closer to or further away from either side of the cavity.

In some embodiments, the present invention may provide for a raised edge extending upward from the top side of the present invention's upper portion. In some embodiments, the raised edge when viewed from the side may resemble a parallelogram resting on an irregular quadrilateral, and when viewed from the front may resemble an oval with narrowed ends and a shorter side, the shorter side being the point of attachment to the present invention's upper portion's top side. In some embodiments, portions of the exposed long side of the raised edge may be tapered, while in other embodiments the exposed long side of the raised edge may not provide for any tapered edge portions.

In other embodiments, the raised edge may be cylindrical, square, or any other shape capable of integration within the present invention.

In some embodiments, the present invention may be made of plastic, metal, wood, an elastomer, one or more other materials, or a combination of materials.

One or more of the above-disclosed embodiments, in addition to certain alternatives, are provided in further detail below with reference to the attached figures. The disclosed subject matter is not, however, limited to any particular embodiment disclosed.

Figure 1:
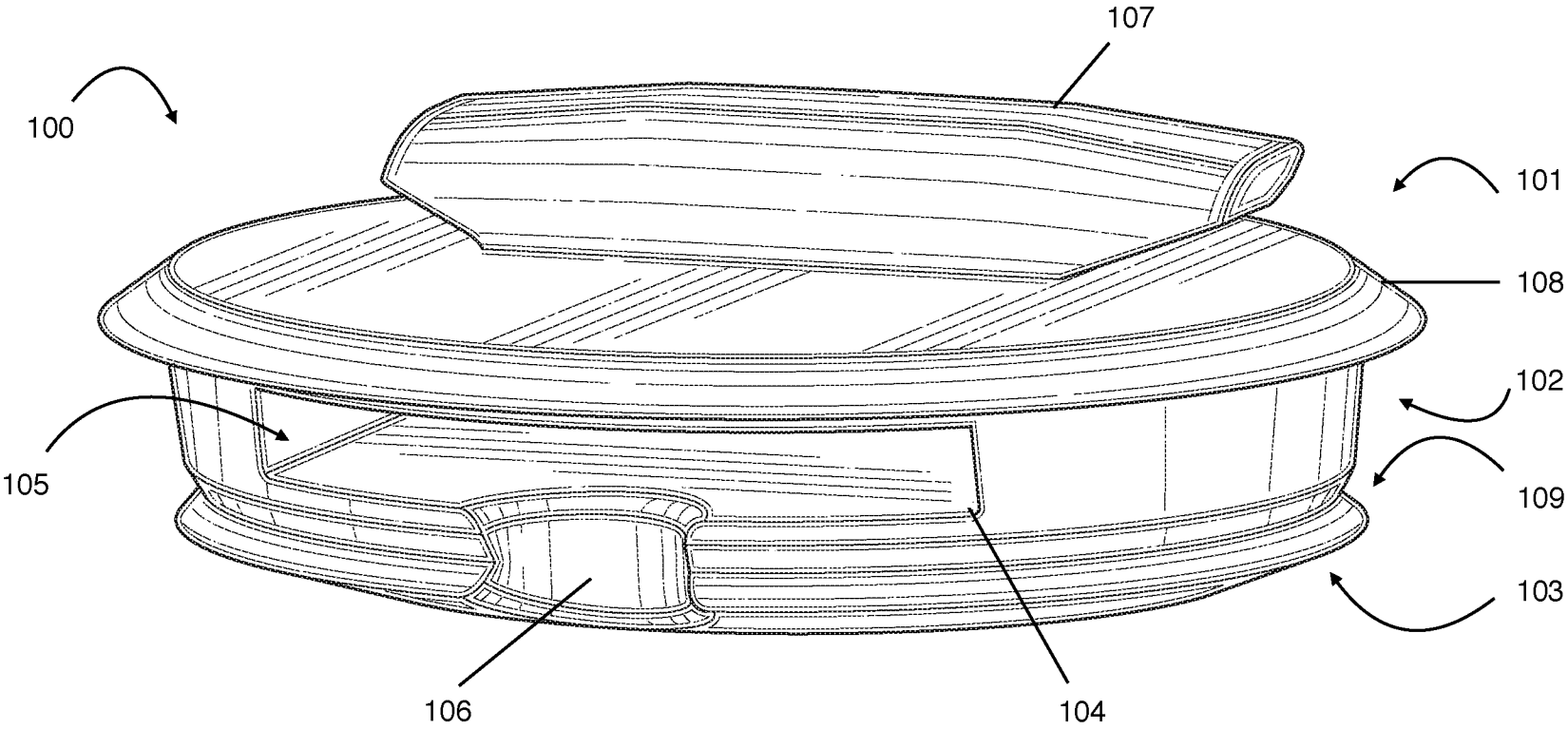
FIG. 1 shows a perspective view of an apparatus for sealing an opened beverage container in accordance with one embodiment of the invention.

For simplicity and clarity of illustration, the drawing figures illustrate the general manner of construction, and descriptions and details of well-known features and techniques may be omitted to avoid unnecessarily obscuring the invention. Additionally, elements in the drawing figures are not necessarily drawn to scale. For example, the dimensions of some of the elements in the figures may be exaggerated relative to other elements to help improve understanding of embodiments of the present invention. The same reference numerals in different figures denote the same elements.

The terms "first," "second," "third," "fourth," and the like in the description and in the claims, if any, are used for distinguishing between similar elements and not necessarily for describing a particular sequential or chronological order. It is to be understood that the terms so used are interchangeable under appropriate circumstances such that the embodiments described herein are, for example, capable of operation in sequences other than those illustrated or otherwise described herein. Furthermore, the terms "include," and "have," and any variations thereof, are intended to cover a non-exclusive inclusion, such that a process, method, system, article, device, or apparatus that comprises a list of elements is not necessarily limited to those elements, but may include other elements not expressly listed or inherent to such process, method, system, article, device, or apparatus.

The terms "couple," "coupled," "couples," "coupling," and the like should be broadly understood and refer to connecting two or more elements or signals, electrically, mechanically or otherwise. Two or more electrical elements may be electrically coupled, but not mechanically or otherwise coupled; two or more mechanical elements may be mechanically coupled, but not electrically or otherwise coupled; two or more electrical elements may be mechanically coupled, but not electrically or otherwise coupled. Coupling (whether mechanical, electrical, or otherwise) may be for any length of time, e.g., permanent or semi-permanent or only for an instant.

DETAILED DESCRIPTION

Having summarized various aspects of the present disclosure, reference will now be made in detail to that which is illustrated in the drawings. While the disclosure will be described in connection with these drawings, there is no intent to limit it to the embodiment or embodiments disclosed herein. Rather, the intent is to cover all alternatives, modifications and equivalents included within the spirit and scope of the disclosure as defined by the appended claims.

With reference to FIG. 1, an embodiment of the present invention may comprise an apparatus for sealing an opened beverage 100, having an upper portion 101, middle portion 102, and lower portion 103. FIG. 1 also discloses cavity 104, opening 105, and notch 106. Furthermore, FIG. 1 also discloses raised edge 107 and tapered edges 108, along with tapered edge groove 109.

Remaining with FIG. 1, it is contemplated that in some embodiments, raised edge 107 may be shaped as a cylinder, a raised rectangle, or any shape compatible with the present invention. Additionally, in some embodiments the present invention may provide for a deeper, shallower, or differently shaped cavity 104, along with a differently shaped opening 105, that may accommodate alternate tab shapes, including by way of illustration and not limitation square or circular tabs, tabs of different thickness, and tabs of different lengths.

Continuing with FIG. 1, in some embodiments middle portion 102 may be configured as an approximately teardrop shape, with the teardrop shape's larger end generally corresponding to the present invention's front side. Additionally, in some embodiments, middle portion 102 may be configured in an approximately cylindrical shape. It is contemplated that in certain embodiments middle portion 102 may be configured so as to provide for continuous contact with the rim of any beverage container's opening, such as by way of illustration and not limitation beverage container opening's rim 606. Similarly, in some embodiments notch 106 may be square, oval, or any other shape capable of integration with the present invention.

Remaining with FIG. 1, it is contemplated that in some embodiments, the outer edge of upper portion 101 may not be tapered. It is also contemplated that in some embodiments the outer edge of lower portion 103 may not be tapered.

Figure 2:
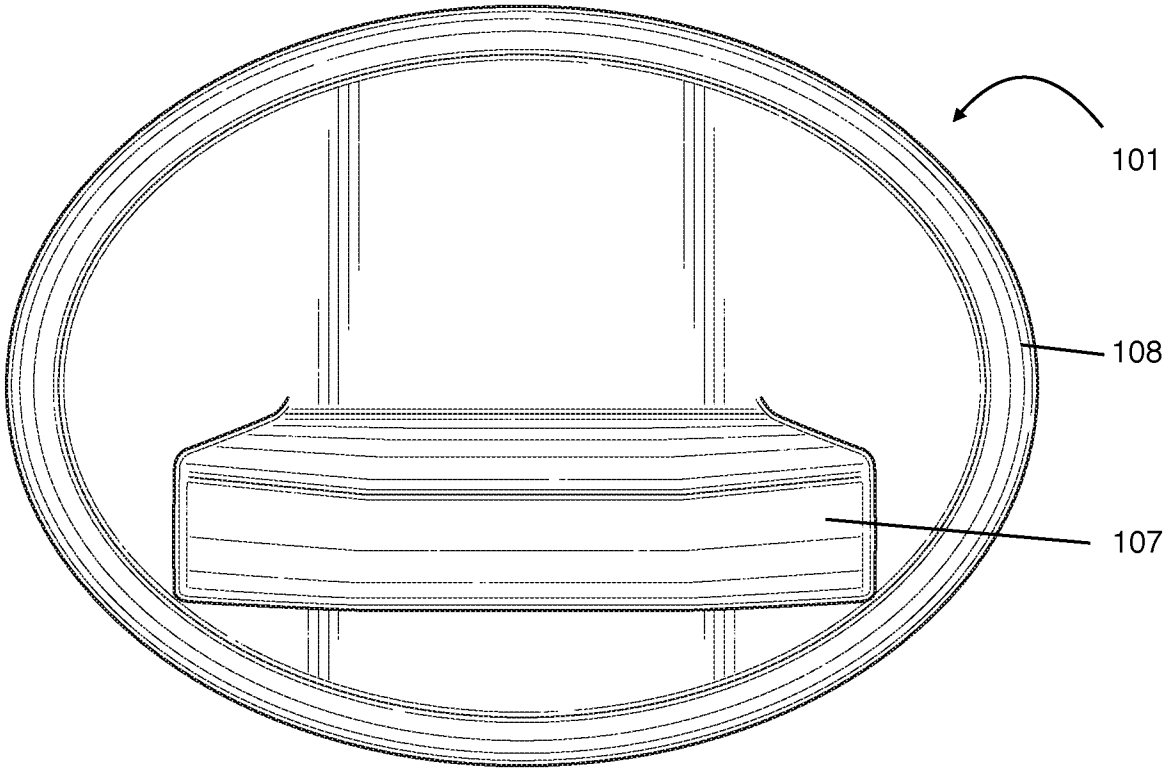
FIG. 2 shows a top plan view of an apparatus for sealing an opened beverage container in accordance with one embodiment of the invention.

Turning attention to FIG. 2, a top plan view of an apparatus for sealing an opened beverage container in accordance with one embodiment of the invention is shown. In the embodiment depicted, raised edge 107, tapered edge 108, and upper portion 101 are disclosed.

Figure 3:
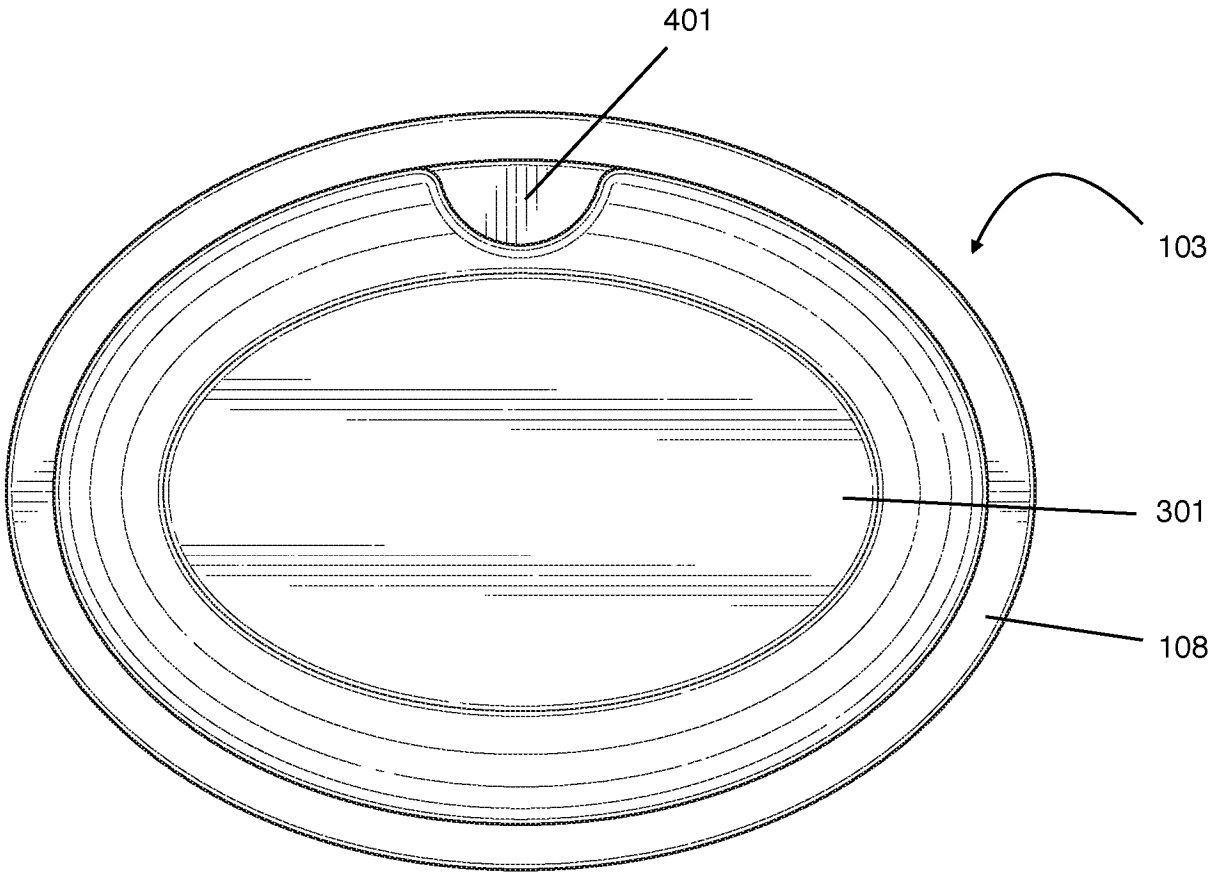
FIG. 3 shows a bottom plan elevational view of an apparatus for sealing an opened beverage container in accordance with one embodiment of the invention.

With respect to FIG. 3, a bottom plan view of an apparatus for sealing an opened beverage container in accordance with one embodiment of the invention is shown. In the embodiment depicted, lower portion is disclosed, along with convex lower side 301. Also depicted in FIG. 3 are notch 106 and tapered edge 108.

Figure 4:
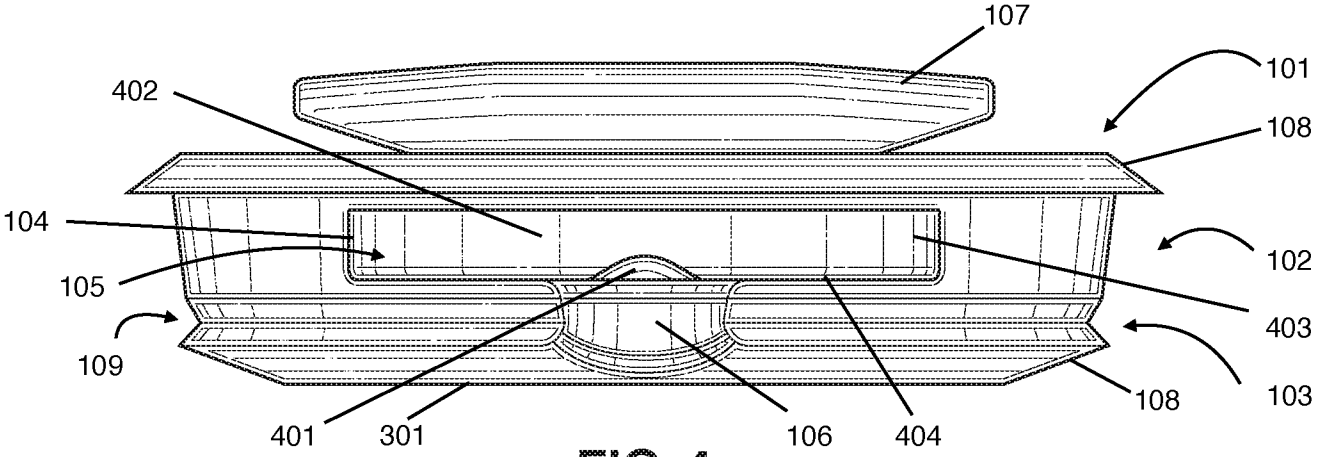
FIG. 4 shows a front elevational view of an apparatus for sealing an opened beverage container in accordance with one embodiment of the invention.

With reference to FIG. 4, a front elevational view of an apparatus for sealing an opened beverage container in accordance with one embodiment of the invention is shown. In the embodiment depicted, upper portion 101 contains tapered edge 108 as well as raised edge 107 and tapered edge groove 109. FIG. 4 also discloses middle portion 102, lower portion 103, notch 106, and cavity 104, which contains opening 105, raised portion 401, arcuate back wall 402, along with cavity walls 403 and cavity floor 404. As can be seen in FIG. 4, raised portion 401 in some embodiments is located approximately in the center of cavity floor 404 and reaches approximately to the middle of cavity 104. FIG. 4 further discloses convex lower side 301.

Figure 5:
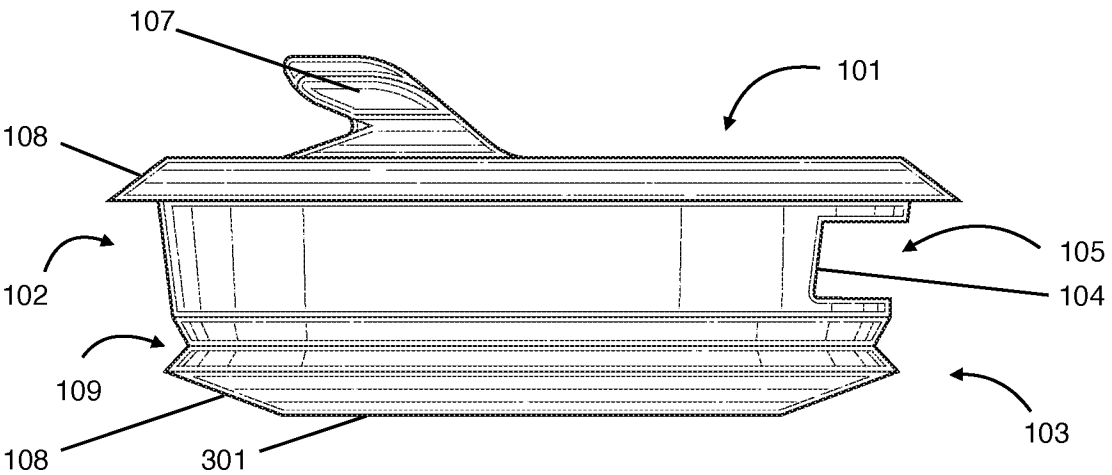
FIG. 5 shows a side elevational view of an apparatus for sealing an opened beverage container in accordance with one embodiment of the invention.

Turning attention to FIG. 5, a side elevational view of an apparatus for sealing an opened beverage container in accordance with one embodiment of the invention is shown. In the embodiment depicted, the configuration of opening 105 can be seen relative to upper portion 101, middle portion 102, lower portion 103, and cavity 104. FIG. 5 also discloses the relative locations of several tapered edges 108, as well as generally discloses raised edge 107 and tapered edge groove 109.

Figure 6A:
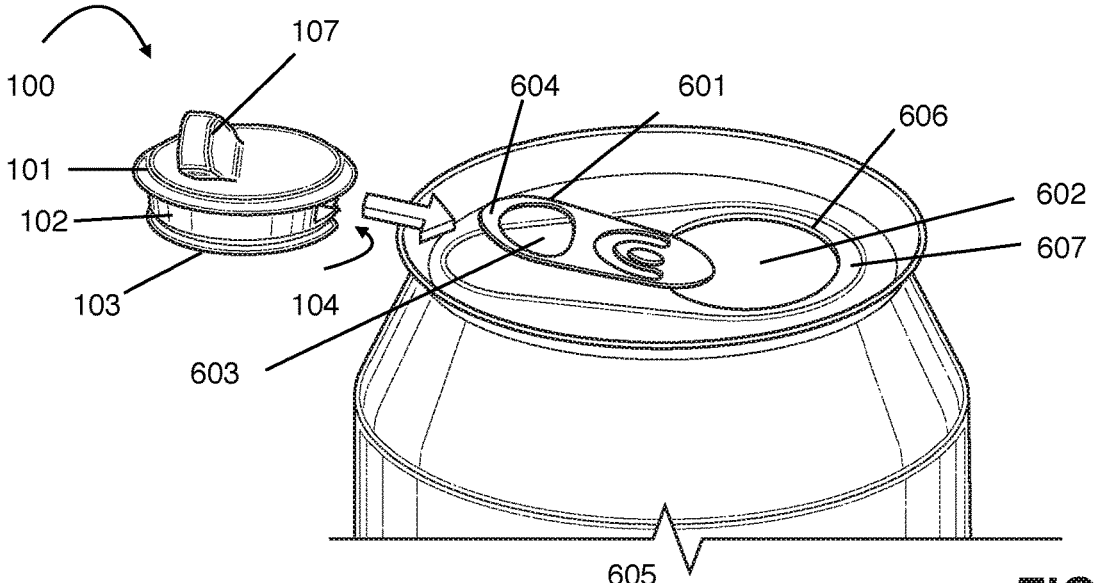
FIGS. 6A-C illustrate an exemplary method of use of an apparatus for sealing an opened beverage container in accordance with one embodiment of the present invention.
Figure 6B:
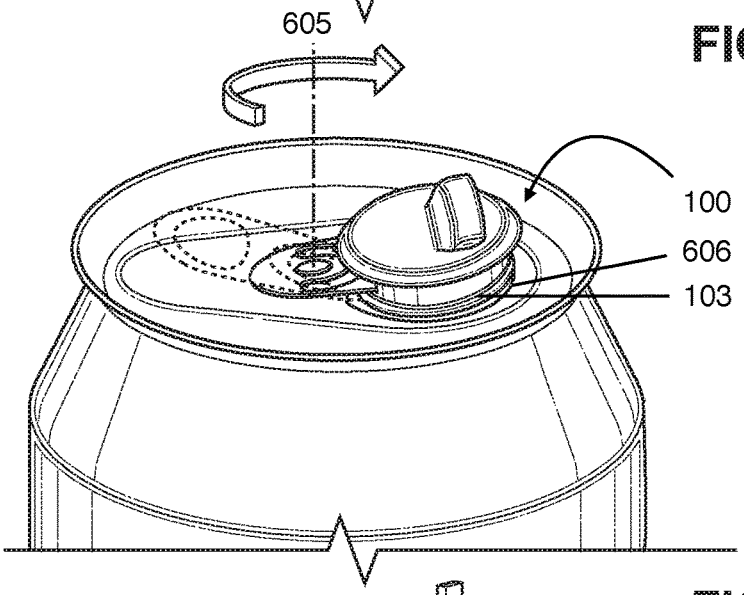
Figure 6C:
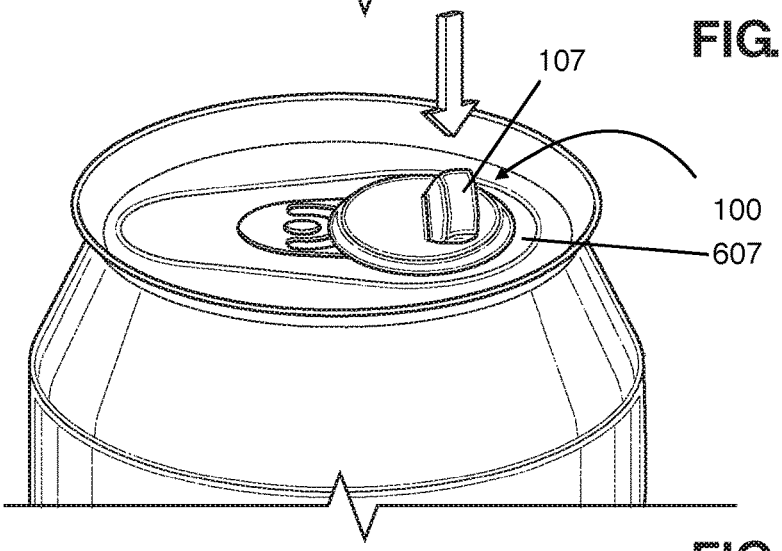

With respect to FIGS. 6A-6C, an exemplary method of using an apparatus for sealing an opened beverage container in accordance with one embodiment of the present invention is shown.

With respect to FIG. 6A, a user may first align apparatus for sealing an opened beverage 100 with beverage container tab 601. The user may then slide apparatus for sealing an opened beverage 100 onto beverage container tab 601. A user may accomplish this sliding motion by first aligning cavity 104 with beverage container tab top portion 604, then sliding apparatus for sealing an opened beverage 100 over beverage container tab 601, causing apparatus for sealing an opened beverage 100 to be in removable connection with beverage container tab 601. FIG. 6A also generally discloses beverage container opening 602, beverage container opening's rim 606, and beverage container upper surface 607.

Continuing with FIG. 6A, in the process of sliding apparatus for sealing an opened beverage 100 into removable connection with beverage container tab 601, in some embodiments raised portion 401 (not pictured) may pass over beverage container tab top portion 604 and remain within beverage tab opening 603, thereby removably securing apparatus for sealing an opened beverage 100 to beverage container tab 601.

Turning attention to FIG. 6B, once apparatus for sealing an opened beverage 100 has been positioned into removable connection with beverage container tab 601, a user may then rotate apparatus for sealing an opened beverage 100 on a rotation defined by central rotational axis 605 of beverage container tab 601 until apparatus for sealing an opened beverage 100 is aligned with beverage tab opening 603. FIG. 6B also generally discloses the spatial relationship between lower portion 103 and beverage container opening's rim 606. In some embodiments, lower portion 103 may have a slightly larger circumference than beverage container opening's rim 606. In other embodiments, lower portion 103 may provide for a slightly smaller circumference or an equal circumference relative to beverage container opening's rim 606.

Remaining with FIG. 6B, in some embodiments the present invention may provide that tapered edge groove 109 may removably receive and secure beverage container opening's rim 606. In some embodiments, when tapered edge groove 109 removably receives and secures beverage container opening's rim 606, this combination may form a seal. In some embodiments, when tapered edge groove 109 removably receives and secures beverage container opening's rim 606, this combination may form an airtight seal.

Turning attention to with FIG. 6C, once apparatus for sealing an opened beverage 100 is in position over beverage container opening 602, a user may push down on apparatus for sealing an opened beverage 100 until lower portion 103 has passed beverage container opening's rim 606, thereby securing apparatus for sealing an opened beverage 100 into place within beverage container opening 602.

Remaining with FIG. 6C, in some embodiments the present invention may provide that when apparatus for sealing an opened beverage 100 is secured into place within beverage container opening 602, lower portion 103 may be in contact with the underside of beverage container upper surface 607, middle portion 102 may be in contact with beverage container opening's rim 606, and upper portion 101 may be in contact with beverage container upper surface 607. Alternatively, in other embodiments, it is contemplated that lower portion 103 may not be in contact with the underside of beverage container upper surface 607, or middle portion 102 may not be in contact with beverage container opening's rim 606, or upper portion 101 may not be in contact with beverage container upper surface 607.

Continuing with FIG. 6C, it is contemplated that in some embodiments, the fit between lower portion 103 and the underside of beverage container upper surface 607 may provide for an airtight seal. In other embodiments, the fit between middle portion 102 and beverage container opening's rim 606 may provide for an airtight seal. In other embodiments, the fit between upper portion 101 and beverage container upper surface 607 may provide for an airtight seal. In still other embodiments, the fit between upper portion 101 and beverage container opening's rim 606 may provide for an airtight seal. In other embodiments, a combination of fits between lower portion 103 and the underside of beverage container upper surface 607, middle portion 102 and beverage container opening's rim 606, upper portion 101 and beverage container upper surface 607, or upper portion 101 and beverage container opening's rim 606 may provide for an airtight seal. In other embodiments, such seal may be less than airtight, yet operative to accomplish the aims of the present invention.

Returning to FIGS. 6A-6C, to allow air to enter beverage container opening 602, a user may apply pressure to raised edge 107 and thereby dislodge apparatus for sealing an opened beverage 100 from its fit within beverage container opening 602. After dislodging the present invention from its sealed position, a user may rotate apparatus for sealing an opened beverage 100 back to its starting position and reverse the alignment generally disclosed in FIG. 6A, thereby removing the present invention from its removable connection to beverage tab 601.

Figure 7:
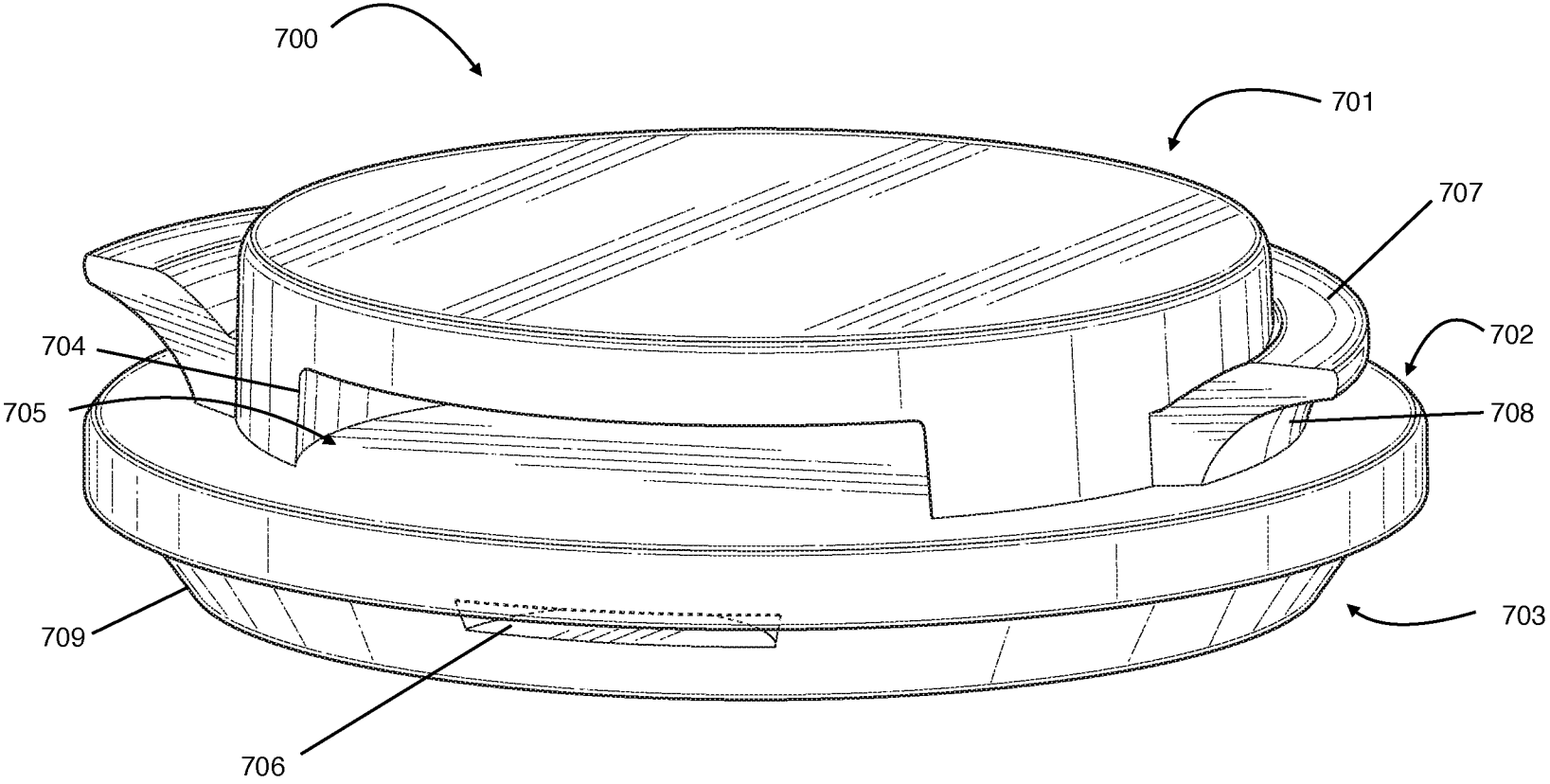
FIG. 7 shows a perspective view of an embodiment of an apparatus for sealing an opened beverage container in accordance.

With respect to FIG. 7, a perspective view of an embodiment of an apparatus for sealing an opened beverage container in accordance in shown. In the embodiment depicted, an alternative embodiment of an apparatus for sealing an opened beverage 700, having an upper portion 701, middle portion 702, and lower portion 703 is disclosed. FIG. 7 also discloses cavity 704, opening 705, and notch 706. Furthermore, FIG. 7 also discloses raised edge 707 and winged flare shape 708, along with tapered lower edge 709.

Figure 8:
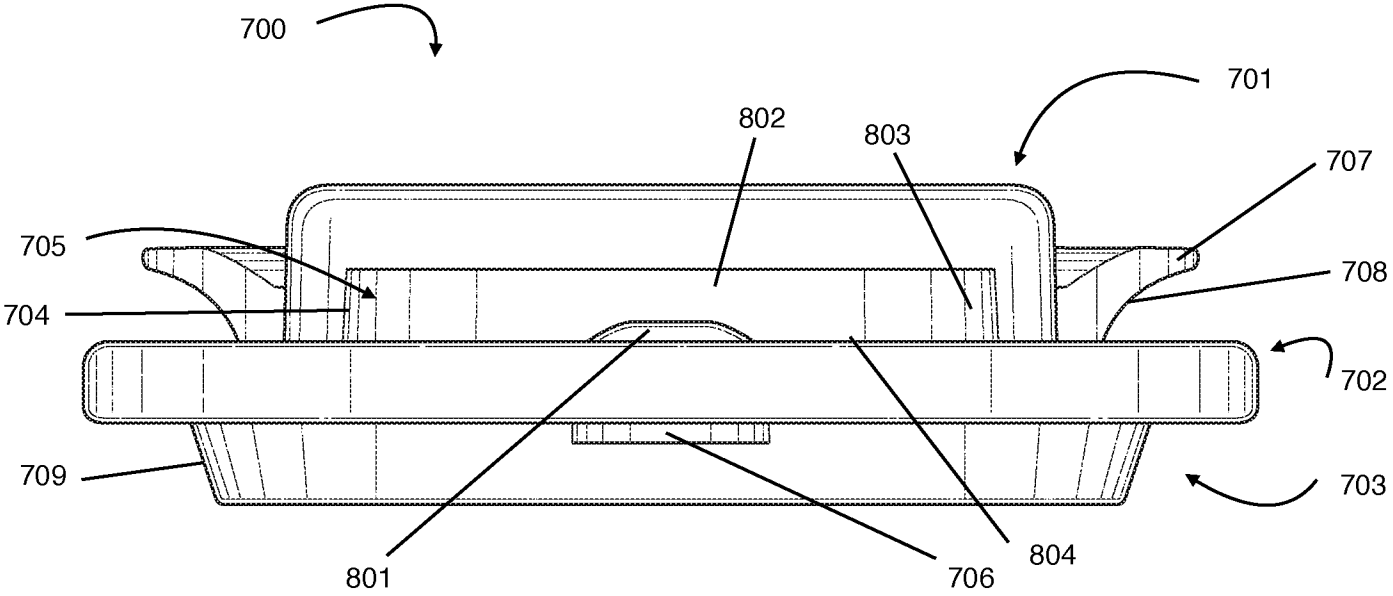
FIG. 8 shows a front elevational view of an embodiment of an apparatus for sealing an opened beverage container in accordance.

Turning attention to FIG. 8, a front elevational view of an embodiment of an apparatus for sealing an opened beverage container in accordance is shown. In the embodiment depicted, alternative embodiment of an apparatus for sealing an opened beverage 700, upper portion 701, middle portion

702, lower portion 703, notch 706, and cavity 704, opening 705, raised edge 707, winged flare shape 708, and tapered lower edge 709 may be perceived, along with raised portion 801, arcuate back wall 802, cavity walls 803 and cavity floor 804. As can be seen in FIG. 8, raised portion 801 in some embodiments is located approximately in the center of cavity floor 804 and reaches approximately to the middle of cavity 704.

It should be emphasized that the above-described embodiments are merely examples of possible implementations. Many variations and modifications may be made to the above-described embodiments without departing from the principles of the present disclosure. All such modifications and variations are intended to be included herein within the scope of this disclosure and protected by the following claims.

Moreover, embodiments and limitations disclosed herein are not dedicated to the public under the doctrine of dedication if the embodiments and/or limitations: (1) are not expressly claimed in the claims; and (2) are or are potentially equivalents of express elements and/or limitations in the claims under the doctrine of equivalents.

CONCLUSIONS, RAMIFICATIONS, AND SCOPE

While certain embodiments of the invention have been illustrated and described, various modifications are contemplated and can be made without departing from the spirit and scope of the invention. Accordingly, it is intended that the invention not be limited, except as by the appended claim(s).

The teachings disclosed herein may be applied to other systems, and may not necessarily be limited to any described herein. The elements and acts of the various embodiments described above can be combined to provide further embodiments. All of the above patents and applications and other references, including any that may be listed in accompanying filing papers, are incorporated herein by reference. Aspects of the invention can be modified, if necessary, to employ the systems, functions and concepts of the various references described above to provide yet further embodiments of the invention.

Particular terminology used when describing certain features or aspects of the invention should not be taken to imply that the terminology is being refined herein to be restricted to any specific characteristics, features, or aspects of the garment and method of using the same with which that terminology is associated. In general, the terms used in the following claims should not be constructed to limit the garment and method of using the same to the specific embodiments disclosed in the specification unless the above description section explicitly define such terms. Accordingly, the actual scope encompasses not only the disclosed embodiments, but also all equivalent ways of practicing or implementing the disclosed garment and method of using the same. The above description of embodiments of the garment and method of using the same is not intended to be exhaustive or limited to the precise form disclosed above or to a particular field of usage.

While specific embodiments of, and examples for, the garment and method of using the same are described above for illustrative purposes, various equivalent modifications are possible for which those skilled in the relevant art will recognize.

While certain aspects of the method and apparatus for sealing an opened beverage container are presented below in particular claim forms, various aspects of the method and apparatus for sealing an opened beverage container are contemplated in any number of claim forms. Thus, the inventor reserves the right to add additional claims after filing the application to pursue such additional claim forms for other aspects of the method and apparatus for sealing an opened beverage container.

What is claimed is:

1. An apparatus for sealing an opened beverage comprising:

a cover member having an upper portion, a middle portion, and a lower portion, the upper portion having a top side and an outer upper edge, the middle portion having a cavity with an opening, the middle portion further having a raised portion, and the lower portion having a lower side and an outer lower edge, a groove forming the boundary between the middle portion and the lower portion, wherein the groove is formed by the juncture of a tapered edge along the lower edge of the middle portion and a tapered edge along the top of the lower portion, and wherein the tapered edge along the lower edge of the middle portion and the tapered edge along the top of the lower portion slope towards each other.

* * * * *